US009437173B2

(12) United States Patent
Terai

(10) Patent No.: US 9,437,173 B2
(45) Date of Patent: Sep. 6, 2016

(54) PIANO ACTION

(71) Applicant: KABUSHIKI KAISHA KAWAI GAKKI SEISAKUSHO, Hamamatsu-shi, Shizuoka (JP)

(72) Inventor: Yasushi Terai, Hamamatsu (JP)

(73) Assignee: KABUSHIKI KAISHA KAWAI GAKKI SEISAKUSHO, Hamamatsu-shi (JP)

( * ) Notice: Subject to any disclaimer, the term of this patent is extended or adjusted under 35 U.S.C. 154(b) by 102 days.

(21) Appl. No.: 14/308,437

(22) Filed: Jun. 18, 2014

(65) Prior Publication Data

US 2015/0000500 A1 Jan. 1, 2015

(30) Foreign Application Priority Data

Jun. 27, 2013 (JP) ..... 2013-135473

(51) Int. Cl.
*G10C 3/18* (2006.01)
*G10C 1/02* (2006.01)
*G10C 3/16* (2006.01)

(52) U.S. Cl.
CPC ..... *G10C 1/02* (2013.01); *G10C 3/161* (2013.01)

(58) Field of Classification Search
USPC ..... 84/242
See application file for complete search history.

(56) References Cited

U.S. PATENT DOCUMENTS

| | | | | |
|---|---|---|---|---|
| 3,435,720 | A * | 4/1969 | Eaton | 84/240 |
| 4,685,371 | A * | 8/1987 | Levinson | 84/239 |
| 5,287,787 | A * | 2/1994 | Inoue | G10C 3/161 84/217 |
| 5,511,454 | A * | 4/1996 | Jones | G10C 3/22 84/236 |
| 5,600,077 | A * | 2/1997 | Honda | G10C 5/005 84/171 |
| 6,639,133 | B1 * | 10/2003 | Wroblewski | G10C 3/16 84/216 |
| 2009/0178534 | A1 * | 7/2009 | Clark | G10C 3/18 84/236 |

FOREIGN PATENT DOCUMENTS

JP 6-8634 3/1994

* cited by examiner

*Primary Examiner* — Christopher Uhlir
(74) *Attorney, Agent, or Firm* — Lewis Roca Rothgerber Christie LLP

(57) ABSTRACT

Obtained is a structure of a piano action by which excellent playing reproducibility is secured even in a case of playing by repeatedly striking a key at an extremely high speed. In a piano action including a plurality of hammers 31 for striking keys, hammer shanks 32 that support the hammers turnably, hammer rails 1 that restrict the hammer shanks 32 from turning after the hammers strike strings, and hammer cushions (shock absorbing materials) 100 that are placed on the hammer rails and absorb motion energy generated by collision with the hammer shanks 32, the hammer cushions (shock absorbing materials) 100 are disposed at an angle so as not to become parallel to contact surfaces of the hammer shanks 32.

8 Claims, 7 Drawing Sheets

PIANO ACTION

CROSS-REFERENCE TO RELATED APPLICATION

This application claims priority to and the benefit of Japanese Patent Application Number 2013-135473, filed on Jun. 27, 2013, the entire disclosure of which is incorporated by reference.

TECHNICAL FIELD

The present invention relates to a piano action in a hammer rail device for an upright piano, and specifically, to a structure of a piano action excellent in playing performance.

BACKGROUND ART

In a hammer rail device for an upright piano, hammers for striking strings are supported by hammer shanks that freely turn, and after striking a string, the striking hammer turns in a direction opposite to the string due to inertia force. The movement of the hammer for striking a string is stopped by collision of the hammer shank with a hammer rail. At this time, to prevent collision noise, etc., from being generated by the stopping of the hammer shank, a hammer cushion made of a material such as felt is attached to the contact surface of the hammer rail.

With the above-described structure of the piano action, due to great inertia of the hammer, when the hammer shank collides with the hammer cushion and rebounds, in a case of playing by repeatedly striking a key at an extremely high speed, the hammer rebounding position is not stable, so that an idle strike (producing no sound) may occur, and this hinders good performance.

Therefore, to reduce the coefficient of restitution on the hammer rail and absorb the motion energy of the hammer shank at the time of collision, for example, as shown in Patent Literature 1, a structure was proposed in which the hammer cushion made of urethane, etc., is formed as a material with shock absorbing characteristics, and the surface of the hammer cushion is provided with a cushion guard with a slit for absorbing vibration caused by hammer shank collision.

CITATION LIST

Patent Literature

Patent Literature 1: Japanese Published Examined Utility Model Application No. H06-8634)

SUMMARY OF INVENTION

Technical Problem

However, with the above-described structure of a piano action, a phenomenon was confirmed in which, in the case where the coefficient of restitution of the hammer cushion was reduced (for example, by using resin such as urethane), the collision noise on the contact surface of the hammer shank increased.

The present invention was proposed in view of the above-described circumstances, and an object thereof is to provide a structure of a piano cushion that can prevent collision noise from being generated by the hammer cushions, and secure excellent playing reproducibility even in a case of playing by repeatedly striking a key at an extremely high speed.

Solution to Problem

To achieve the above object, the present invention of the claim 1 is a piano action comprising a plurality of hammers for striking strings; hammer shanks that support the respective hammers turnably; hammer rails that restrict the hammer shanks from turning after the hammers strike strings, and hammer cushions that are placed on the hammer rails and absorb motion energy generated by collision with the hammer shanks, wherein the hammer cushions are disposed at an angle so as not to become parallel to contact surfaces of the hammer shanks.

Claim 2 is the piano action according to claim 1, wherein the hammer cushions are shaped so that when the hammer shanks collide with the hammer cushions, the hammer shanks come into contact with parts of the hammer cushions first.

Claim 3 is the piano action according to claim 1, wherein the hammer cushions are shaped so that when the hammer shanks collide with the hammer cushions, lower positions of the hammer shanks come into contact with the hammer cushions first.

Claim 4 is the piano action according to any one of claims 1 to 3, wherein each of the hammer cushions is made of low repulsion urethane resin.

Claim 5 is the piano action according to claim 1, wherein each of the hammer cushions is made of a felt material and a low repulsion urethane resin material that are divided in the longitudinal direction of the hammer shank.

Claim 6 is the piano action according to claim 5, wherein the low repulsion urethane resins of the hammer cushions are disposed at an angle so as not to become parallel to contact surfaces of the hammer shanks.

Advantageous Effects of Invention

With the piano action according to the present invention, by disposing the hammer cushion on the hammer rail at an angle so as not to become parallel to the contact surface of the hammer shank, the hammer shank comes into contact with a part of the hammer cushion first, and then the hammer shank entirely comes into contact with the hammer cushion due to subsequent warping of the hammer cushion, so that an excellent shock absorbing effect can be obtained.

In addition, the hammer shank comes into contact with a part of the hammer cushion first, so that the area of the contact portion at the start of collision is reduced, and accordingly, the collision noise can be reduced.

DESCRIPTION OF EMBODIMENTS

Hereinafter, an example of an embodiment of the present invention is described with reference to the drawings.

Figure 1:
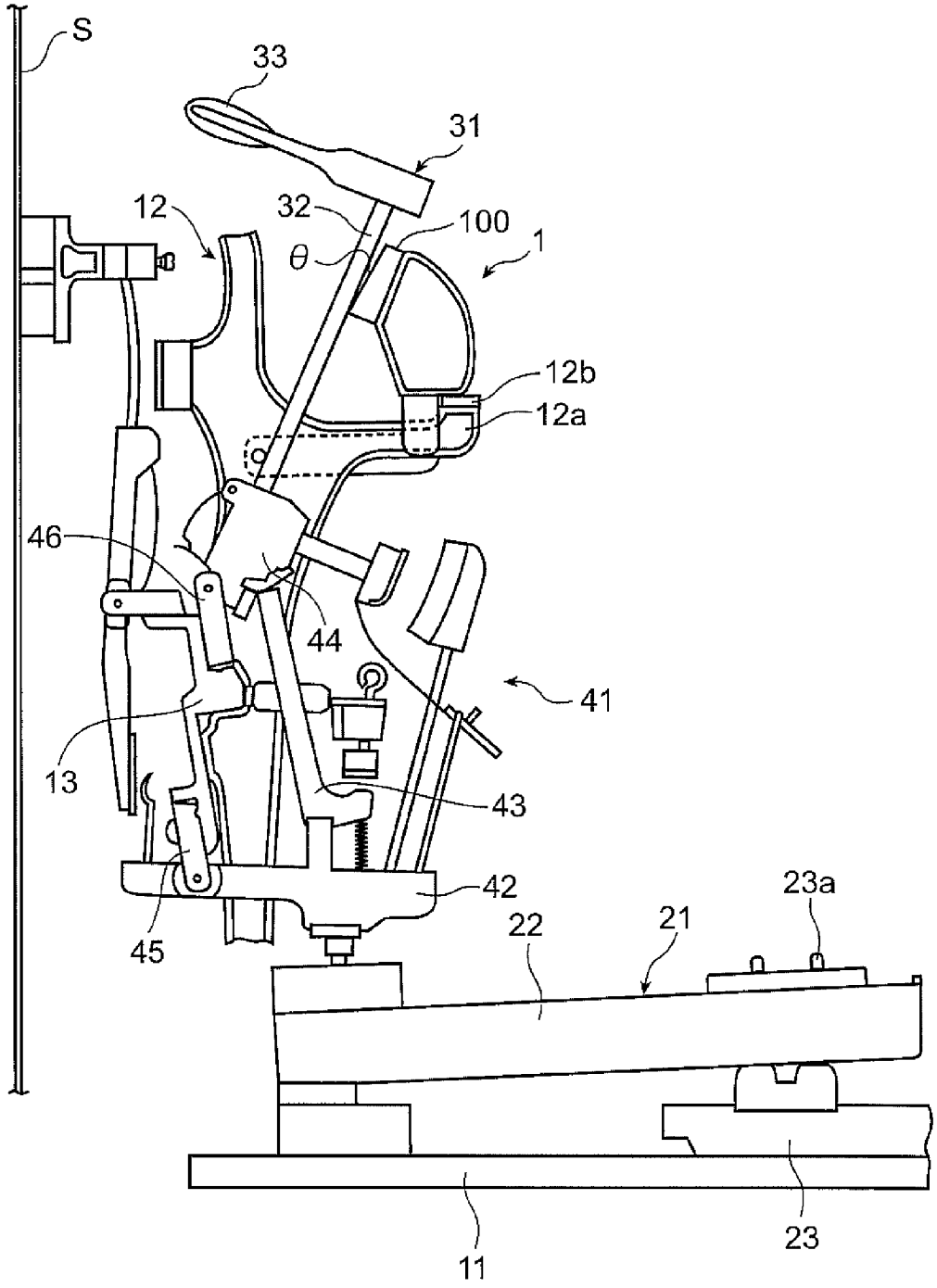
FIG. 1 is a side sectional explanatory view showing an entire structure of a hammer rail device with a piano action according to an embodiment of the present invention.

A hammer rail device with a piano action according to an embodiment of the present invention includes a keyboard 21, hammers 31, and actions 41, etc., as shown in FIG. 1.

FIG. 1 shows a key releasing state of the hammer rail device, and description is given by defining the player side as "front" and the opposite side as "rear" as viewed from the player side. In all drawings including this figure, for convenience, hatching is omitted.

The keyboard 21 consists of many keys 22 (only one is illustrated) lined up in the left-right direction (depth direction of FIG. 1). Each key 22 is supported turnably by a balance pin 23*a* provided upright on a reed 23, and the reed 23 is attached to the upper surface of a keybed 11.

The hammer 31 is provided for each key 22 (only one is illustrated), and each hammer 31 includes a hammer shank 32 formed into a thin and long bar shape circular in section and a hammer head 33 provided on the upper end portion of the hammer shank 32.

The hammer shank 32 is provided upright on the upper surface of the butt 44 described later of the action 41, and extends in the up-down direction.

In the key releasing state, the hammer shank 32 is in contact with a hammer cushion (shock absorbing material) 100 of the hammer rail 1 described later, and the hammer head 33 faces a string S taut vertically on the rear side. The hammer rail 1 and the shock absorbing material 100 disposed on the hammer rail are formed to be long and continuous in the left-right direction (front-back direction of FIG. 1).

The action 41 includes wippens 42, jacks 43, and the butts 44 provided for each of the keys 22, and is attached to a center rail 13 extending long in the left-right direction, and disposed above the rear end portion of the keyboard 21.

The wippen 42 and butt 44 are supported turnably on a wippen flange 45 and a butt flange 46 attached to the center rail 13, respectively.

The wippens 42 in the key releasing state are placed on the rear end portions of the corresponding keys 22.

The jacks 43 are supported turnably on the upper end portions of the wippens 42, and in the key releasing state, the jacks are engaged with the butts 44 from below.

With the above-described constitution, when the key 22 is pressed, the wippen 42 is pushed up by the key 22 and accordingly turns upward together with the jack 43, and accordingly, the jack 43 pushes up the butt 44.

By this operation, the hammer 31 turns toward the string S together with the butt 44 and separates from the hammer rail 1, and thereafter, the hammer head 33 strikes the string S to produce a piano sound.

Then, when key pressing is ended, the wippen 42, the jack 43, and the hammer 31 return to the original positions before key pressing, and the hammer 31 comes into contact with the hammer cushion (shock absorbing material) 100 of the hammer rail 1.

In this series of operations, when the hammer shank 32 collides with the hammer cushion (shock absorbing material) 100 and rebounds, in some cases of playing by repeatedly striking a key at an extremely high speed, the rebounding position of the hammer 31 is not stable and the operation becomes unstable, so that an idle strike (producing no sound) occurs. The present invention provides a structure for preventing this phenomenon from occurring by devising the shape of the hammer cushion (shock absorbing material) 100 of the hammer rail 1.

In addition, the hammer rail device includes the hammer rails 1 and brackets 12 that support the hammer rails 1 turnably. The brackets 12 are provided at the left end portion (end portion of the low note side), the center, and the right end portion (end portion of the high note side) of the rear end portion of the keybed 11, respectively (only the bracket on the right end portion is illustrated). Each bracket 12 is made of, for example, aluminum light alloy and extends in the up-down direction, and the upper end portion of each bracket is fixed to a post by an action bolt (these are not illustrated), and the lower end portion is fixed to an action base (not illustrated) placed on the keybed 11.

The bracket 12 includes a rail support portion 12*a* (stopper) extending forward from the center of the bracket, and to the front end portion of the upper surface of the rail support portion 12*a*, a shock absorbing material 12*b* made of, for example, felt is bonded.

To the lower portion of the bracket 12, the above-described center rail 13 is fixed.

Next, a constitution of the characteristic portion of the piano action according to the present embodiment is described with reference to FIG. 1 and FIG. 2.

As the shape of the conventional hammer cushion (shock absorbing material) 100 disposed on the hammer rail 1, the hammer shank 32 and the upper surface of the hammer cushion 100 are positioned in parallel to each other and form contact surfaces, however, the hammer cushion 100 according to the present embodiment is disposed at an angle so as not to become parallel to the contact surface of the hammer shank 32.

Specifically, although the hammer cushion in the conventional structure is shaped so that the hammer shank 32 comes into contact with the entire hammer cushion 100, the hammer cushion is shaped so that the hammer shank 32 comes into contact with a part of the hammer cushion 100 first and then entirely comes into contact with the entire hammer cushion 100 due to subsequent warping of the shock absorbing material 100. In detail, the hammer cushion is formed so that a predetermined angle θ formed between the hammer shank 32 and the hammer cushion 100 when the side surface position of the hammer shank 32 is at a position at which the side surface position of the hammer shank 32 starts to come into contact with the upper surface of the hammer cushion 100 is 3 degrees or more.

Figure 2:
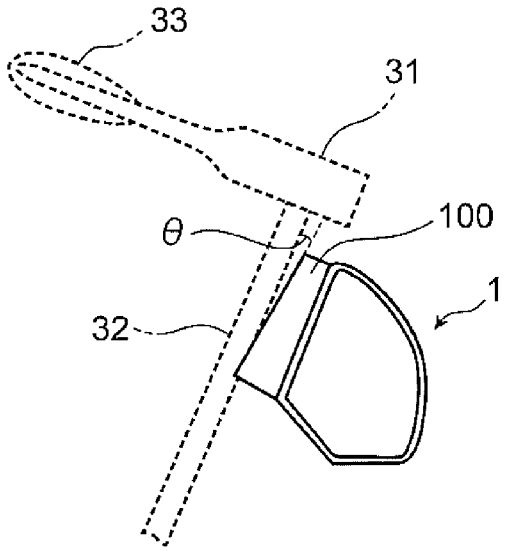
FIG. 2 is a side explanatory view of a piano action portion in the hammer rail device shown in FIG. 1.

For example, in the example shown in FIG. 1 and FIG. 2, by placing the hammer cushion 100 having a shock absorbing material the upper surface of which is sloped by a predetermined angle θ on the hammer rail 1 having the same shape as conventionally, the closer to the lower side of the hammer shank 32, the more the upper surface of the shock absorbing material protrudes with respect to the hammer rail 1.

Figure 3A:
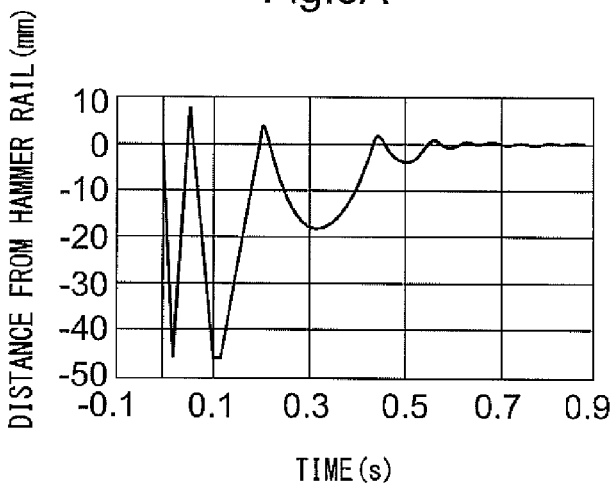
FIG. 3A is a graph showing repulsion force characteristics of shock absorbing materials, and a repulsion force characteristic chart in a case where needle felt is used.
Figure 3B:
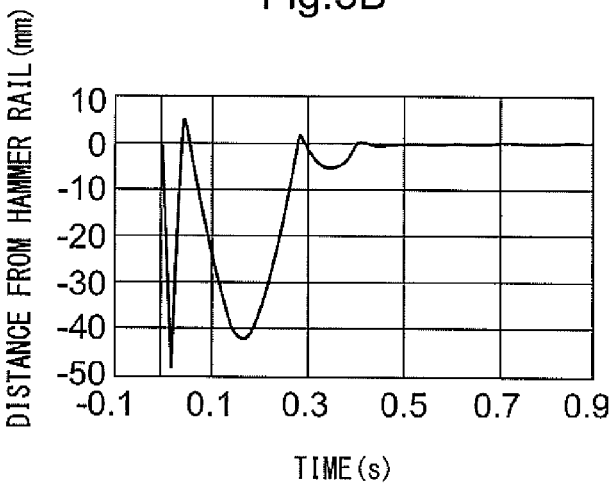
FIG. 3B is a graph showing repulsion force characteristics of shock absorbing materials, and a repulsion force characteristic chart in a case where low repulsion urethane resin is used.

The hammer cushion (shock absorbing material) 100 is entirely made of low repulsion urethane resin. The low repulsion urethane resin is excellent in repulsion force absorbability as compared with the repulsion force characteristics of the needle felt conventionally used, and in detail, as compared with the characteristics of needle felt (FIG. 3A), low repulsion urethane resin has characteristics that shorten the motion convergence time of the hammer shank (FIG. 3B). The characteristic graphs shown in FIGS. 3A & 3B show the results of measurements of the distance (vertical axis) of the hammer shank 32 from the hammer rail 1 with respect to the time (horizontal axis).

The modulus of repulsion elasticity of low repulsion urethane resin to be used for the hammer cushion (shock absorbing material) 100 is preferably approximately 0.20 or less.

Figure 4:
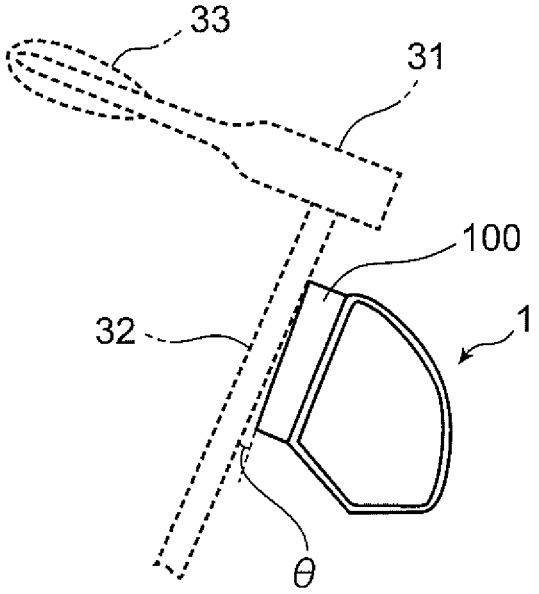
FIG. 4 is a side explanatory view of a piano action portion showing an example of another embodiment.

FIG. 4 shows another embodiment of the piano action as an example in which the hammer cushion (shock absorbing material) 100 is shaped so that an upper position of the hammer shank 32 comes into contact with the hammer cushion first when the hammer shank 32 collides with the hammer cushion. In FIG. 4, portions constituted similar to those in FIG. 1 and FIG. 2 are designated by the same reference symbols.

In this example, the hammer cushion (shock absorbing material) 100 is entirely made of low repulsion urethane resin.

Figure 5:
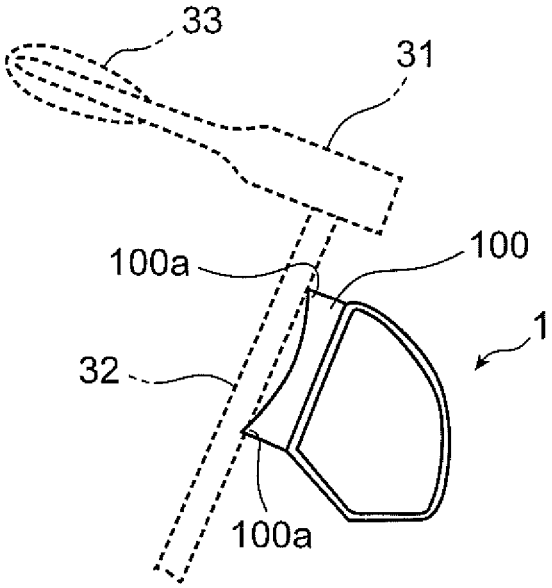
FIG. 5 is a side explanatory view of a piano action portion showing an example of another embodiment.

FIG. 5 shows another embodiment of the piano action in which the upper and lower ends of the shape of the hammer cushion (shock absorbing material) 100 are provided with protrusions 100*a*. In this case, when the hammer shank 32 collides with the shock absorbing material 100, the hammer shank 32 comes into contact with the protrusions 100*a* first. In FIG. 5, portions constituted similar to those in FIG. 1 and FIG. 2 are designated by the same reference symbols.

In this example, the hammer cushion (shock absorbing material) 100 is entirely made of low repulsion urethane resin.

Figure 6:
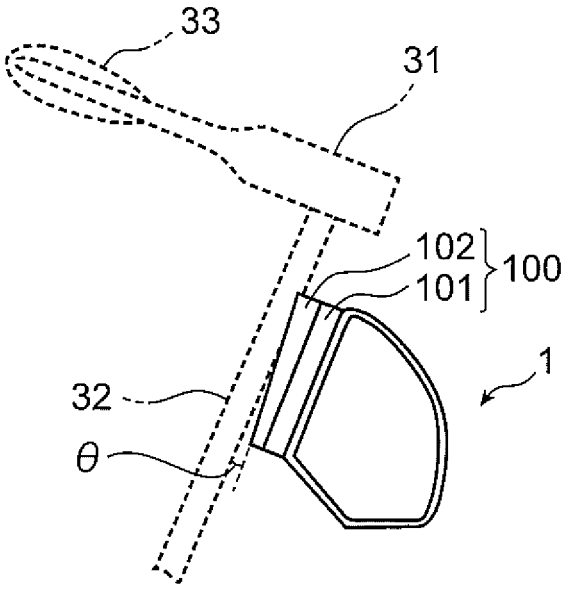
FIG. 6 is a side explanatory view of a piano action portion showing an example of another embodiment.

FIG. 6 shows another embodiment of the piano action in which, although the shape of the hammer cushion (shock absorbing material) 100 is the same as that in FIG. 4, the shock absorbing material 100 is formed to have a two-layered structure including a low repulsion urethane resin material 101 on the hammer rail 1 side and a felt material 102 disposed on the low repulsion urethane resin material. In this case, when the hammer shank 32 collides with the shock absorbing material 100, the hammer shank comes into contact with an upper position of the felt material 102 first. In FIG. 6, portions constituted similar to those in FIG. 1 and FIG. 2 are designated by the same reference symbols.

Figure 7:
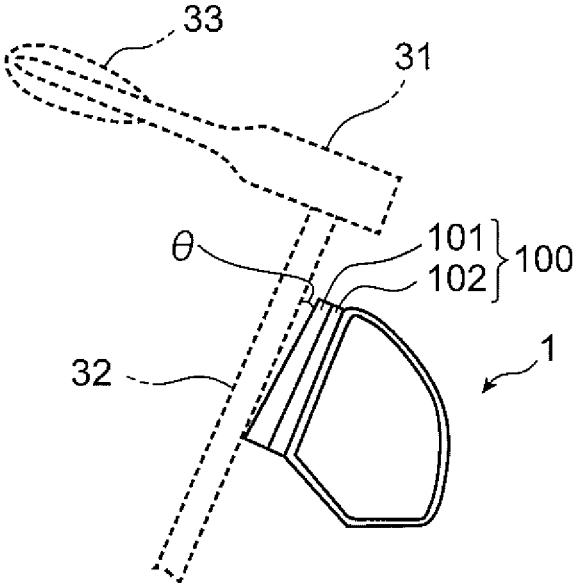
FIG. 7 is a side explanatory view of a piano action portion showing an example of another embodiment.

FIG. 7 shows another embodiment of the piano action in which, although the shape of the hammer cushion (shock absorbing material) 100 is the same as that in FIG. 2, the shock absorbing material 100 is formed to have a two-layered structure including a felt material 102 on the hammer rail 1 side and a low repulsion urethane resin material 101 disposed on the felt material. In this case, when the hammer shank 32 collides with the shock absorbing material 100, the hammer shank 32 comes into contact with a lower position of the low repulsion urethane resin material 101 first. In FIG. 7, portions constituted similar to those in FIG. 1 and FIG. 2 are designated by the same reference symbols.

Figure 8:
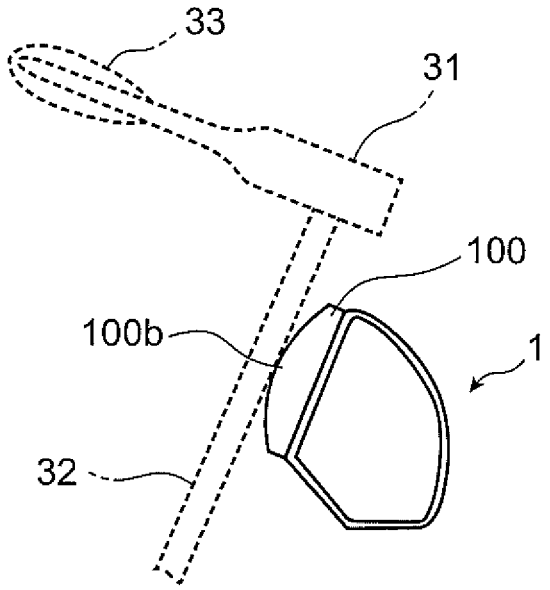
FIG. 8 is a side explanatory view of a piano action portion showing an example of another embodiment.

FIG. 8 shows another embodiment of the piano action in which, as the shape of the hammer cushion (shock absorbing material) 100, an arc-shaped protrusion 100*b* with an arc-shaped section is provided at the center position. In this case, when the hammer shank collides with the shock absorbing material 100, the hammer shank comes into contact with the arc-shaped protrusion 100*b* at the center first. In FIG. 8, portions constituted similar to those in FIG. 1 and FIG. 2 are designated by the same reference symbols.

In this example, the hammer cushion (shock absorbing material) 100 is entirely made of low repulsion urethane resin.

Figure 9:
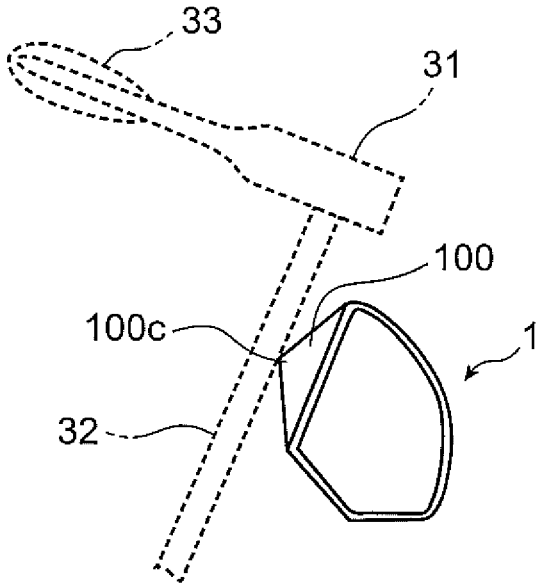
FIG. 9 is a side explanatory view of a piano action portion showing an example of another embodiment.

FIG. 9 shows another embodiment of the piano action in which, as the shape of the hammer cushion (shock absorbing material) 100, a mountain-shaped protrusion 100*c* is provided at the center position. In this case, when the hammer shank 32 collides with the shock absorbing material 100, the hammer shank 32 comes into line contact with the mountain-shaped protrusion 100*c* at the center first. In FIG. 9, portions constituted similar to those in FIG. 1 and FIG. 2 are designated by the same reference symbols.

In this example, the hammer cushion (shock absorbing material) 100 is entirely made of low repulsion urethane resin.

Figure 10:
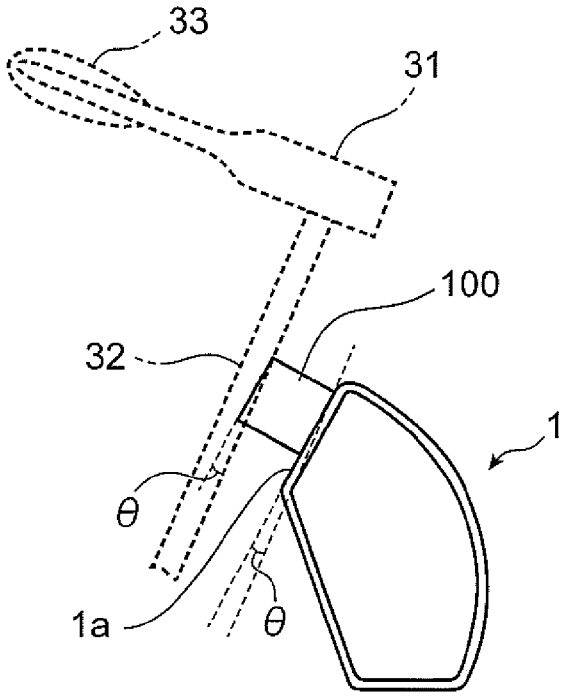
FIG. 10 is a side explanatory view of a piano action portion showing an example of another embodiment.

FIG. 10 shows another embodiment of the piano action in which an upper surface 1*a* of the hammer rail 1 is sloped (predetermined angle θ) with respect to the conventional hammer rail 1 so that when the shock absorbing material 100 placed on the hammer rail collides with the hammer shank 32, a lower position of the hammer shank 32 comes into contact with the shock absorbing material first.

Specifically, the hammer cushion (shock absorbing material) 100 itself is shaped to be rectangular in section without being sloped on the upper surface side so that the hammer cushion has an angle so as not to become parallel to the contact surface of the hammer shank 32 when the hammer cushion is placed on the upper surface 1*a* of the hammer rail 1. In FIG. 10, portions constituted similar to those in FIG. 1 and FIG. 2 are designated by the same reference symbols.

In this example, the hammer cushion (shock absorbing material) 100 is entirely made of low repulsion urethane resin.

Figure 11:
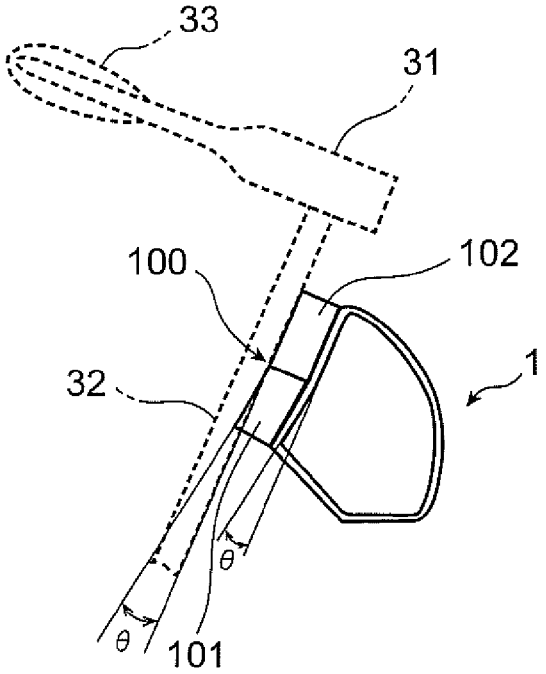
FIG. 11 is a side explanatory view of a piano action portion showing an example of another embodiment.

FIG. 11 shows another embodiment of the piano action in which the hammer cushion (shock absorbing material) 100 is made of the low repulsion urethane resin material 101 and the felt material 102 that are divided in the longitudinal direction of the hammer shank 32.

Specifically, a slope surface (predetermined angle θ) is formed at a lower position on the upper surface of the hammer rail 1, the low repulsion urethane resin material 101 being rectangular in section is placed on this position, and on an upper position thereof, a felt material 102 being rectangular in section is placed so that when the hammer cushion (shock absorbing material) 100 collides with the hammer shank 32, a lower position of the hammer shank 32 comes into contact with the low repulsion urethane resin material 101 first. In FIG. 11, portions constituted similar to those in FIG. 1 and FIG. 2 are designated by the same reference symbols.

Figure 12:
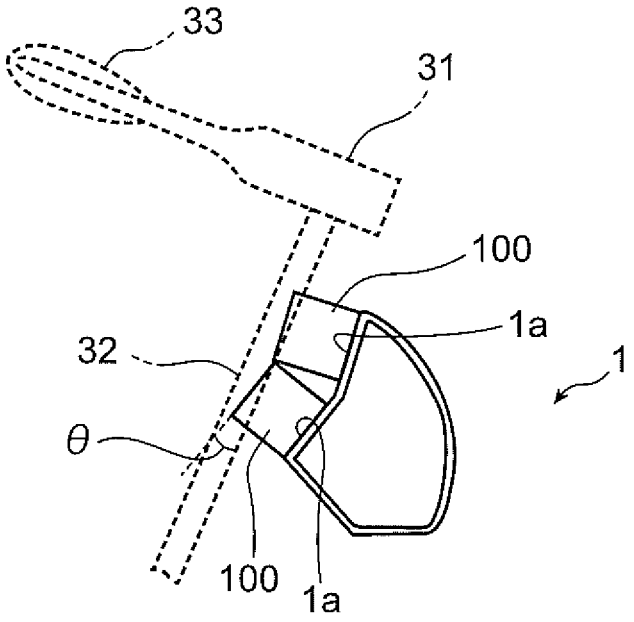
FIG. 12 is a side explanatory view of a piano action portion showing an example of another embodiment.

FIG. 12 shows another embodiment of the piano action in which the hammer cushion 100 is formed of two low repulsion urethane resin materials 101 that are divided in the longitudinal direction of the hammer shank 32.

Specifically, by individually slopping the upper surfaces 1*a* of the hammer rails 1, when rectangular shock absorbing materials 100 are placed thereon, as in the case of the embodiment shown in FIG. 5 in which protrusions are formed on both end portions of the hammer cushion 100, the effect in which, at the time of collision with the hammer shank 32, the hammer shank 32 comes into contact with both end positions of the shock absorbing material 100 first can be obtained.

Each hammer cushion (shock absorbing material) 100 itself is shaped to be rectangular in section without being sloped on the upper surface side, and accordingly, the hammer cushion has an angle (predetermined angle θ) to the contact surface of the hammer shank 32 when the hammer cushion is placed on the upper surface 1*a* of the hammer rail 1. In FIG. 10, portions constituted similar to those in FIG. 1 and FIG. 2 are designated by the same reference symbols.

In this example, the two shock absorbing materials 100 are entirely made of low repulsion urethane resin, respectively.

According to the respective embodiments described above, the hammer cushion (shock absorbing material) 100 is disposed on the hammer rail 1 at an angle so as not to become parallel to the contact surface of the hammer shank 32, so that the hammer shank 32 moves to come into contact with a part of the hammer cushion 100 first and then entirely come into contact with the hammer cushion due to subsequent warping of the shock absorbing material 100, so that an excellent shock absorbing effect can be obtained, and the rebounding position of the hammer 31 can be made stable and the operation can be stabilized.

Also, by reducing the area of the contact portion at the start of collision, the collision noise can be reduced.

As a result, even when a low repulsion resin material with a low coefficient of restitution is used as the hammer cushion (shock absorbing material) 100, in a case of playing by repeatedly striking a key at an extremely high speed, excellent playing reproducibility can be secured while continuously suppressing generation of collision noise.

The invention claimed is:

1. A piano action for an upright piano comprising:

a plurality of hammers, each for striking a respective one of a plurality of strings;

a plurality of hammer shanks, each for turnably supporting a respective hammer;

a plurality of hammer rails that restrict the hammer shanks from turning after the hammers strike strings; and a plurality of hammer cushions, a first surface of each placed on a respective one of the hammer rails to absorb motion energy generated by collision with a contact surface of a respective hammer shank as a key associated with the respective hammer shank is returned to a key released state, wherein each of the hammer cushions has a second surface opposite to the first surface that is sloped at an angle and having a larger thickness at one end and a shorter thickness at another end in such a way that the second sloped surface is not parallel to the contact surface of the respective hammer shank in a key pressed state, and the key released state, and wherein a distance between the second sloped surface and the contact surface of the respective hammer shank increases along an upper portion of the respective hammer shank towards the respective hammer in the key released state.

2. The piano action according to claim 1, wherein each of the hammer cushions is shaped so that when the key associated with the respective hammer shank is in the release state and the respective hammer shank collides with an associated hammer cushion, the respective hammer shank comes into contact first with said one end of the associated hammer cushion that has a larger thickness.

3. The piano action according to claim 1, wherein the hammer cushions are shaped so that when the contact surfaces of the hammer shanks collide with the hammer cushions, lower positions of the hammer shanks come into contact with the hammer cushions first.

4. The piano action according to claim 1, wherein each of the hammer cushions is made of low repulsion urethane resin.

5. The piano action according to claim 2, wherein each of the hammer cushions is made of low repulsion urethane resin.

6. The piano action according to claim 3, wherein each of the hammer cushions is made of low repulsion urethane resin.

7. The piano action according to claim 1, wherein each of the hammer cushions is made of a felt material and a low repulsion urethane resin material that are divided in the longitudinal direction of the respective hammer shank.

8. The piano action according to claim 7, wherein the low repulsion urethane resins of the hammer cushions are disposed at an angle so as not to become parallel to contact surfaces of the hammer shanks.

* * * * *